US011245183B2

(12) United States Patent
Liu et al.

(10) Patent No.: US 11,245,183 B2
(45) Date of Patent: Feb. 8, 2022

(54) MULTI-ANTENNA SYSTEM AND MOBILE TERMINAL

(71) Applicant: AAC Technologies Pte. Ltd., Singapore (SG)

(72) Inventors: Shijie Liu, Shenzhen (CN); Ge Zhang, Shenzhen (CN); Yue Liang, Shenzhen (CN)

(73) Assignee: AAC Technologies Pte. Ltd., Singapore (SG)

( * ) Notice: Subject to any disclaimer, the term of this patent is extended or adjusted under 35 U.S.C. 154(b) by 32 days.

(21) Appl. No.: 16/524,053

(22) Filed: Jul. 27, 2019

(65) Prior Publication Data

US 2020/0044331 A1 Feb. 6, 2020

(30) Foreign Application Priority Data

Aug. 3, 2018 (CN) ..... 201810879378.1

(51) Int. Cl.
*H01Q 1/52* (2006.01)
*H01Q 21/06* (2006.01)
*H01Q 1/24* (2006.01)

(52) U.S. Cl.
CPC ..... *H01Q 1/523* (2013.01); *H01Q 1/243* (2013.01); *H01Q 21/06* (2013.01)

(58) Field of Classification Search
None
See application file for complete search history.

(56) References Cited

U.S. PATENT DOCUMENTS

| | | | | |
|---|---|---|---|---|
| 9,369,187 | B1 * | 6/2016 | Sammeta | H04B 1/40 |
| 9,543,644 | B2 * | 1/2017 | Wu | H01Q 1/523 |
| 2009/0219213 | A1 * | 9/2009 | Lee | H01P 5/185 343/700 MS |
| 2010/0141536 | A1 * | 6/2010 | Zhang | H01Q 1/243 343/702 |
| 2011/0237207 | A1 * | 9/2011 | Bauder | H01Q 1/521 455/78 |
| 2012/0218162 | A1 * | 8/2012 | Aoki | H01Q 1/242 343/835 |
| 2019/0165466 | A1 * | 5/2019 | Xu | H01Q 1/521 |
| 2019/0326683 | A1 * | 10/2019 | Su | H01Q 21/0006 |

* cited by examiner

*Primary Examiner* — Crystal L Hammond
(74) *Attorney, Agent, or Firm* — W&G Law Group

(57) ABSTRACT

The present disclosure provides a multi-antenna system comprising at least two antenna units and a neutralization line for connecting two adjacent antenna units, and the neutralization line is provided with an inductor element. The invention also provides a mobile terminal. The multi-antenna system and the mobile terminal provided by the present disclosure could significantly increase the isolation degree between the antenna units by providing a neutralization line between the two adjacent antenna units for connecting the same and providing an inductor element on the neutralization line, thereby reducing the mutual coupling interference between antenna units and improving the antenna performance.

8 Claims, 5 Drawing Sheets

MULTI-ANTENNA SYSTEM AND MOBILE TERMINAL

TECHNICAL FIELD

The present disclosure relates to the field of wireless communication technologies, and in particular, to a multi-antenna system for a mobile terminal.

BACKGROUND

With the vigorous development of 5G communication technology, more and more attention has been paid to researches thereon. Multiple Input Multiple Output (MIMO) technology is a core technology for 50 antennas, and the implementation of multi-antennas is the basis of MIMO technology.

As the design for mobile terminals becomes more and more thin, the arrangement of the antennas is inevitably tight due to limitation on size of mobile terminals, thus causing a problem that the mutual coupling interference of adjacent antennas at same frequency bands are strong.

In the prior art, the main solution for mutual coupling interference between multi-antennas is widening the spacing between the antennas, but the widened spacing is limited by the size of devices. Additionally, the problem could also be solved by introducing a neutralization line between the antennas, but the neutralization line technology has a strict requirement on antennas, and neutralization line needs to reach a certain length to have an effect.

Therefore, it is necessary to provide a new multi-antenna system to solve the above problems.

DETAILED DESCRIPTION

The present disclosure will now be further described with reference to the drawings and embodiments.

Figure 1:
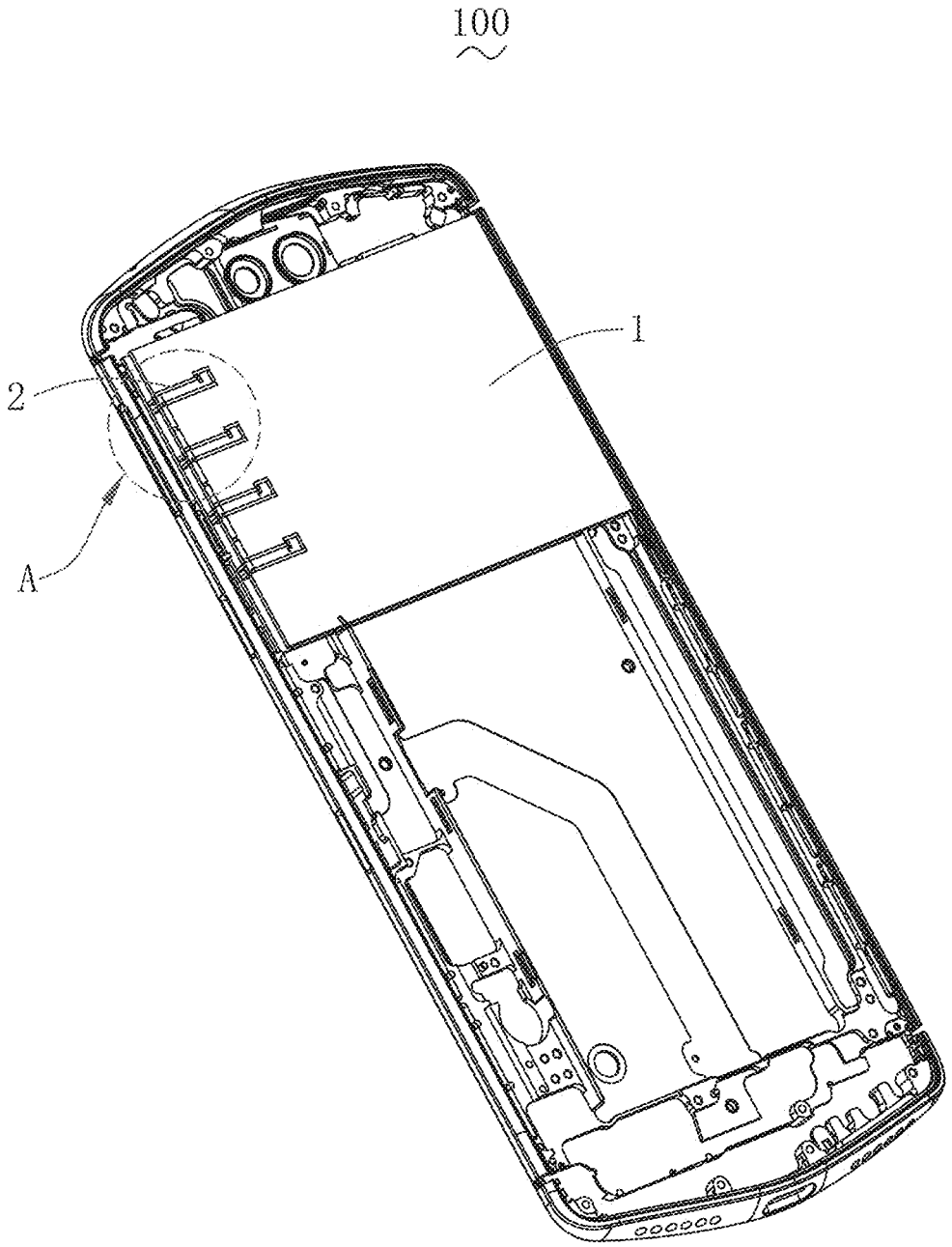
FIG. 1 is a schematic structural diagram illustrating a part of a mobile terminal according to an embodiment of the present disclosure.
Figure 2:
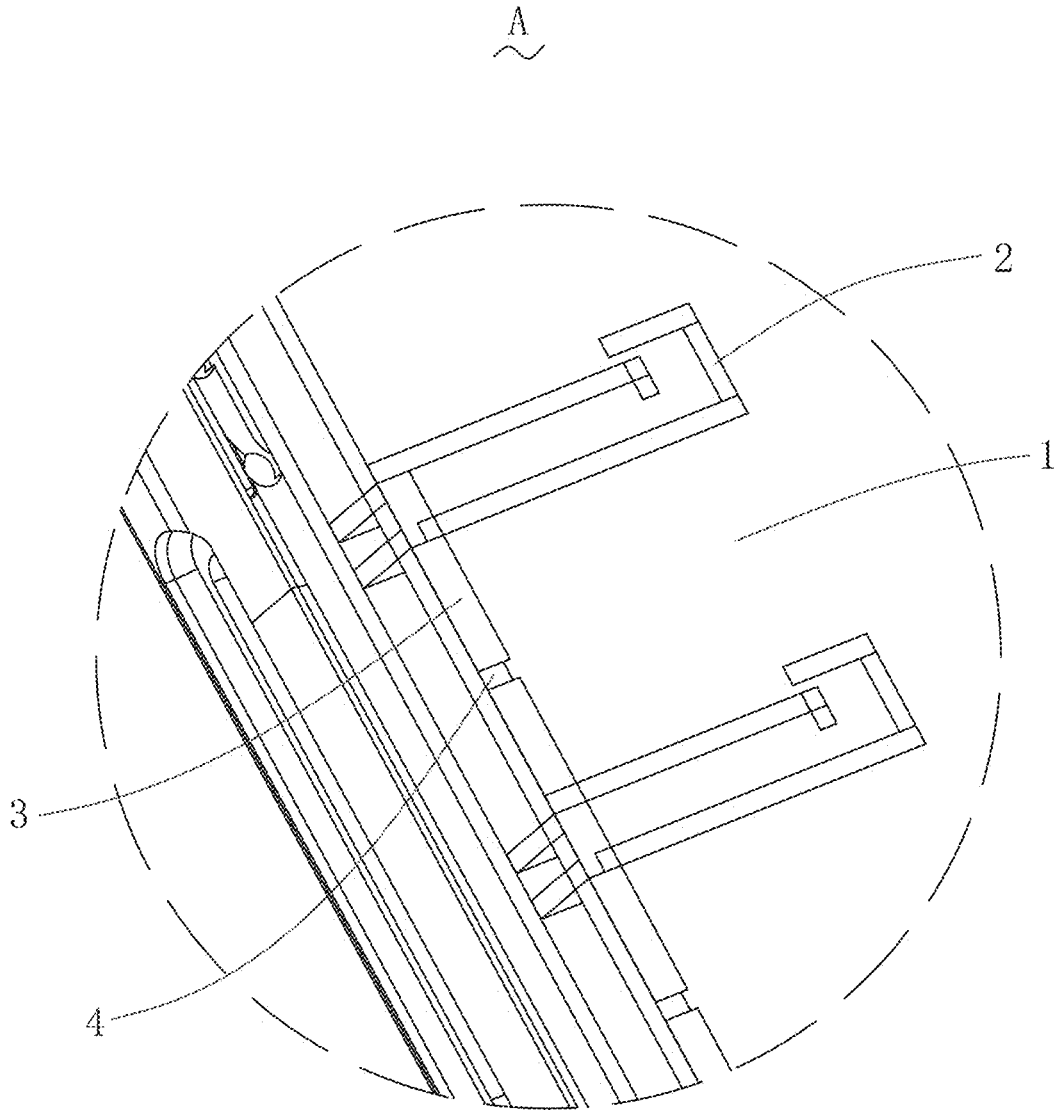
FIG. 2 is a partial enlarged view of part A as shown in FIG. 1.

As shown in FIGS. 1 and 2, an embodiment of the present disclosure provides a mobile terminal 100 comprising a multi-antenna system that may receive and transmit electromagnetic wave signals, thereby implementing a communication function of a mobile terminal, herein, the mobile terminal may be a mobile phone, an ipad, a POS machine, etc., which is not limited in this disclosure.

Specifically, the multi-antenna system comprises a PCB board 1, a plurality of antenna units 2 connected to a ground line of the PCB board 1, a neutralization line 3 connecting two adjacent antenna units 2, and an inductor element 4 disposed on the neutralization line 3, where, the PCB board

1 is the main board of the mobile terminal. In this embodiment, the number of the antenna units 2 is four, and the neutralization line 3 is connected between each two of the adjacent antenna units 2, and the two adjacent antenna units 2 are connected together through the neutralization line 3. The neutralization line 3 generates resonance at an operating frequency band of the antenna so as to form a high-resistance structure, which may change the conduction of current between the two adjacent antenna units and may reduce the coupling interference therebetween. Since the neutralization line 3 has to be a certain length for reducing the coupling interference, and the length of the neutralization line 3 is limited by the size of device, the present disclosure increases the internal resistance of the neutralization line 3 by providing an inductor element on the neutralization line 3, thereby increasing the isolation degree between the antenna units and reducing the coupling interference. The inductor element 4 may be any one of an inductor, a coil and a microstrip line, and the inductance value thereof is controlled to be 10 nH to 50 nH.

Figure 3:
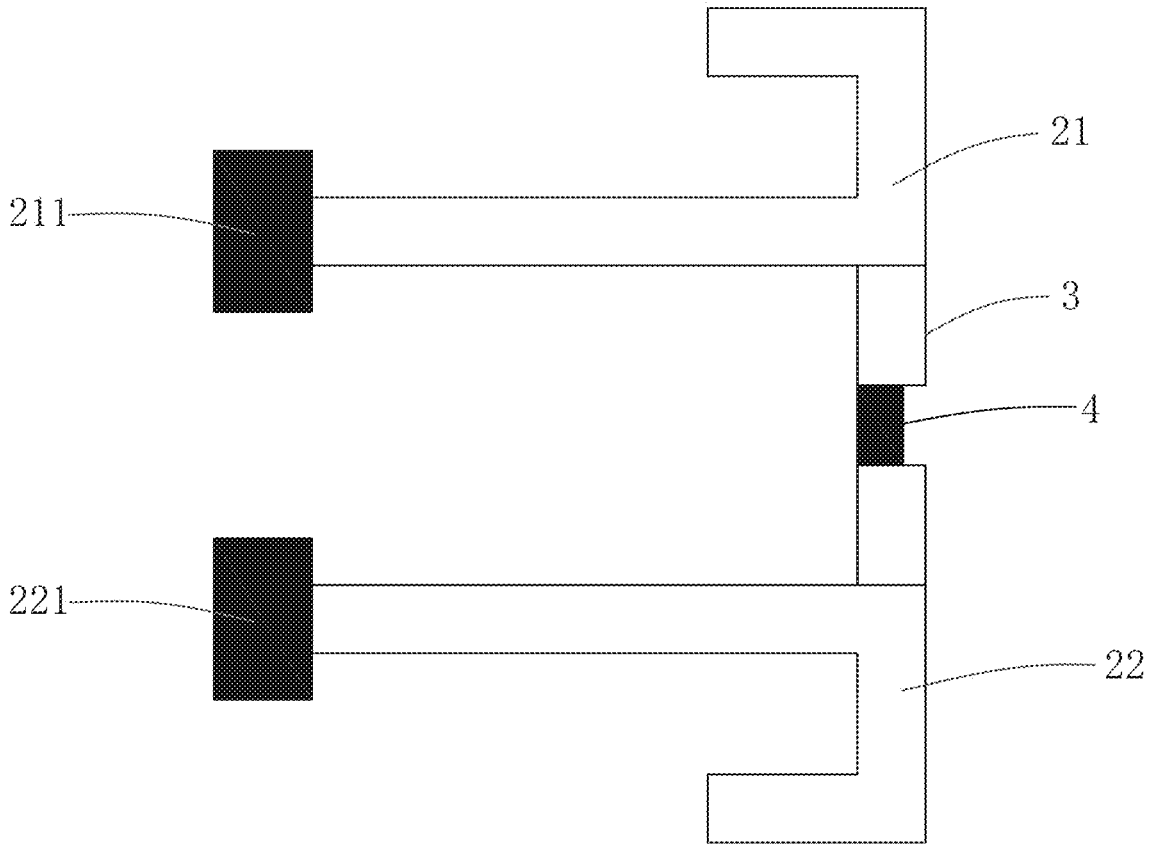
FIG. 3 is a schematic diagram of a multi-antenna system in the mobile terminal as shown in FIG. 1.

In the present embodiment, in order to better explain the idea of the present disclosure, the principle of the present disclosure will be described below with reference to FIG. 3. FIG. 3 is a schematic diagram of a multi-antenna system in the mobile terminal as shown in FIG. 1. Taking any two adjacent antenna units as an example, a first antenna unit 21 and a second antenna unit 22 are defined respectively, where the first antenna unit 21 and the second antenna unit 22 are respectively disposed at the same end of the PCB board and they share a common grounding line of the PCB board. If no isolation measure is taken, a strong coupling current is formed between the first feeding end 211 of the first antenna unit 21 and the second feeding end 221 of the second antenna unit 22, resulting in a serious mutual signal interference between the first antenna unit 21 and the second antenna unit 22. The neutralization line 3 is provided between the first antenna unit 21 and the second antenna unit 22 for connecting the same, and the neutralization line 3 is provided with an inductor element 4, which is equivalent to providing a high-resistance structure between the first antenna unit 21 and the second antenna unit 22, thereby effectively reducing the mutual coupling between the first antenna unit 21 and the second antenna unit 22, so as to effectively prevent the mutual signal interference between the first antenna unit 21 and the second antenna unit 22.

Thus, although the two adjacent antenna units 2 share a common grounding line, the mutual interference therebetween is greatly reduced as the two antenna units are isolated by using the neutralization line 3 with the inductor element 4.

In the present embodiment, the antenna unit 2 is an FPC antenna, for example. Of course, other antenna forms may also be adopted, and the present disclosure is not limited thereto.

Further, the inductor element 4 is generally disposed at a midpoint of the neutralization line 3, which may be directly disposed on the PCB board, without influencing the layout of other electronic elements of the mobile terminal.

Further, the multi-antenna system comprises 8 antenna units, the multi-antenna system is a MIMO multi-antenna array of 8*8, and operating frequency bands thereof are 3.4-3.6 GHz and/or 4.8-5.0 GHz.

Figure 4:
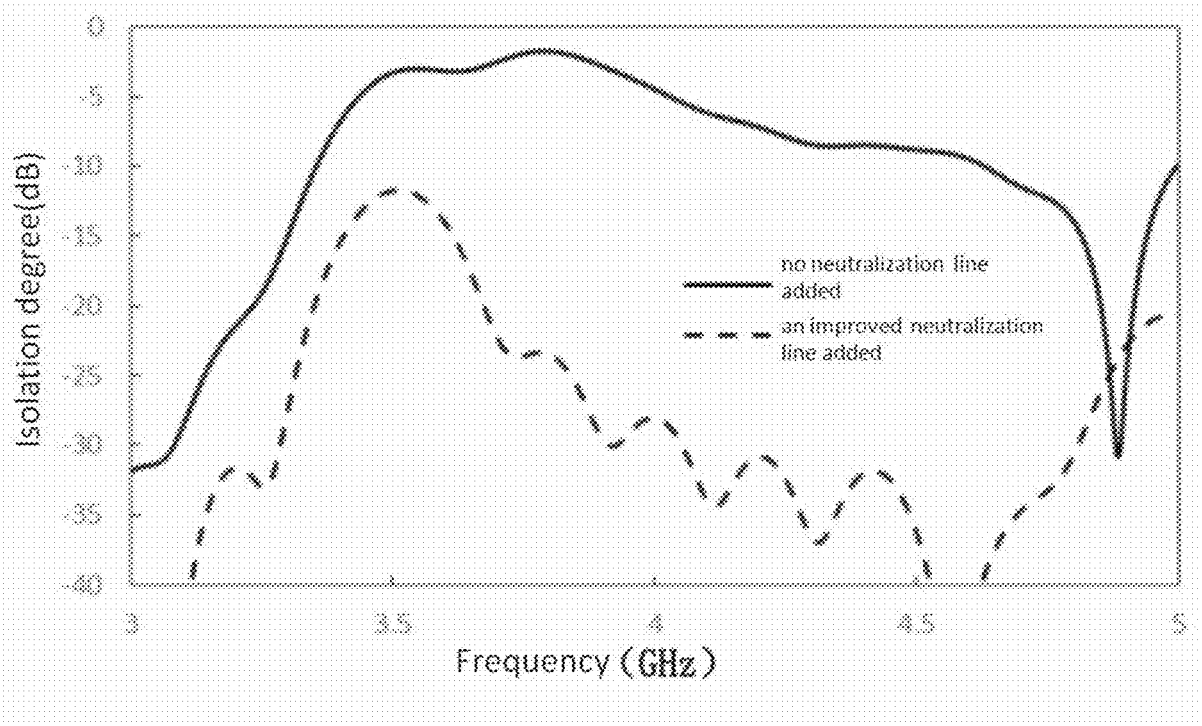
FIG. 4 is a diagram illustrating isolation degree comparison between an existing multi-antenna system and the multi-antenna system according to an embodiment of the present disclosure.

FIG. 4 is a diagram illustrating isolation degree comparison between an existing multi-antenna system and the multi-antenna system according to an embodiment of the present disclosure, where the solid line and the broken line respectively represent the isolation degrees when no neutralization line is added and when an improved neutralization line (i.e. a neutralization line provided with an inductor element) is added. As shown in FIG. 4, after the improved neutralization line is added, the absolute value of the isolation degree is significantly increased, which indicates that the isolation degree between the antenna units is increased, thereby effectively reducing the mutual coupling interference between the antenna units.

Figure 5:
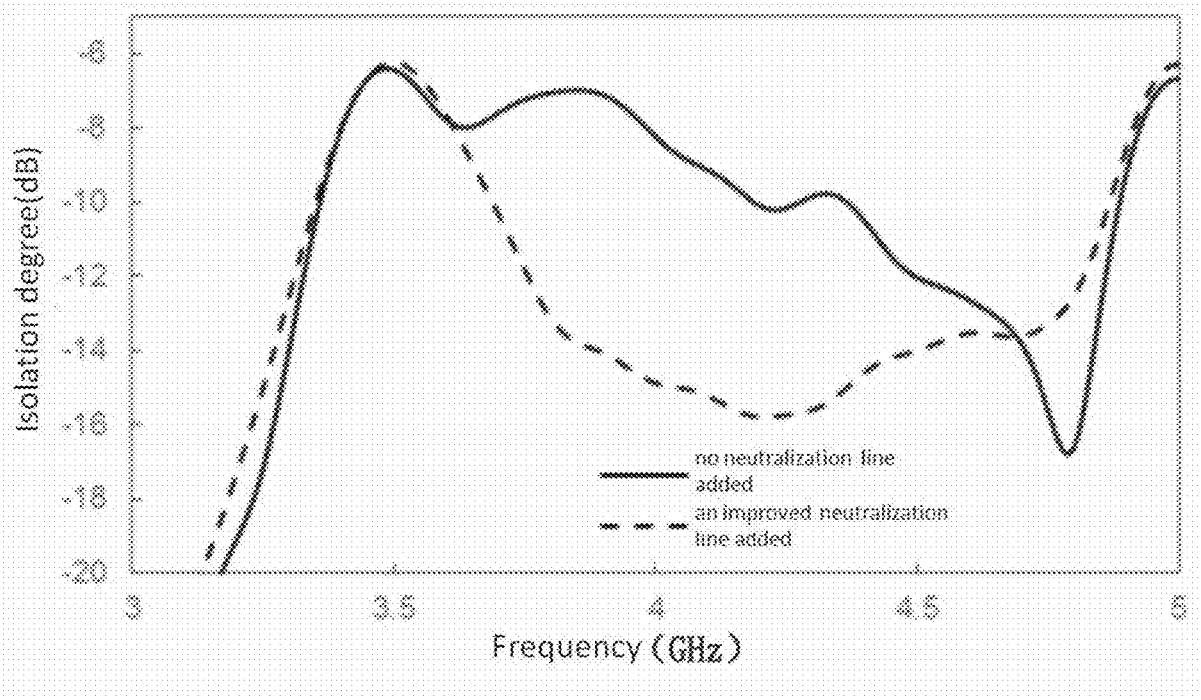
FIG. 5 is a diagram illustrating antenna efficiency comparison between an existing multi-antenna system and the multi-antenna system according to an embodiment of the present disclosure.

FIG. 5 is a diagram illustrating antenna efficiency comparison between an existing multi-antenna system and the multi-antenna system according to an embodiment of the present disclosure, where the solid line and the broken line respectively represent the isolation degrees when no neutralization line is added and when an improved neutralization line (i.e. a neutralization line provided with an inductor element) is added. As shown in FIG. 5, after the improved neutralization line is added, the antenna efficiency is significantly improved in the operating frequency band of 3.4-3.6 GHz and 4.8-5.0 GHz, which indicates that the antenna performance is improved obviously after adding the improved neutralization line.

Compared with the prior art, the multi-antenna system and the mobile terminal provided by the present disclosure have the following beneficial effects:

1) A neutralization line is provided between two adjacent antenna units for connecting the same and the neutralization line is provided with an inductor element, and the neutralization line with the inductor element could significantly increase the isolation degree between the antenna units, thereby reducing the mutual coupling interference between antenna units and improving the antenna performance;
2) The inductor element could shorten the length of the neutralization line, which provides space for arrangement of other electronic elements of the mobile terminal and thus facilitating miniaturization of the mobile terminal.

The above only illustrates the embodiments of the present disclosure but is not intended to limit the scope of the disclosure, and equivalent structures or equivalent process transformations made by using the contents of the present disclosure and the drawings, or direct or indirect applications to other related technology fields are all included in the scope of patent protection of the present disclosure.

What is claimed is:

1. A multi-antenna system comprising at least two antenna units, wherein the multi-antenna system further comprises a neutralization line for connecting two adjacent antenna units, and the neutralization line is provided with an inductor element, and only inductor element is provided on the neutralization line; wherein the inductor element has an inductance value of 10 nH to 50 nH.

2. The multi-antenna system according to claim 1, wherein the number of the antenna units is greater than two, each two adjacent antenna units are connected by the neutralization line, and each neutralization line is provided with an inductor element.

3. The multi-antenna system of claim 2, wherein the inductor element is disposed at a midpoint of the neutralization line.

4. The multi-antenna system of claim 2, wherein the inductor element is any one of an inductor, a coil, and a microstrip line.

5. The multi-antenna system of claim 2, wherein the multi-antenna system is a MIMO multi-antenna array of 8*8.

6. The multi-antenna system of claim 5, wherein the MIMO multi-antenna array of 8*8 has operating frequency bands of 3.4-3.6 GHz and/or 4.8-5.0 GHz.

7. The multi-antenna system of claim 1 wherein the antenna unit is an FPC antenna.

8. A mobile terminal comprising a multi-antenna system, the multi-antenna system comprises at least two antenna units, wherein the multi-antenna system further comprises a neutralization line for connecting two adjacent antenna units, and the neutralization line is provided with an inductor element, and only inductor element is provided on the neutralization line; wherein the inductor element has an inductance value of 10 nH to 50 nH.

* * * * *